US011662102B2

(12) United States Patent
Kim et al.

(10) Patent No.: US 11,662,102 B2
(45) Date of Patent: May 30, 2023

(54) AIR CONDITIONER INCLUDING AN AIRFLOW GUIDE TO GUIDE AIR BEING DISCHARGED

(71) Applicant: Samsung Electronics Co., Ltd., Suwon-si (KR)

(72) Inventors: Byungghun Kim, Suwon-si (KR); Seung-Tek Lee, Suwon-si (KR); Chang-Woo Jung, Suwon-si (KR); Sunghyun Chun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 263 days.

(21) Appl. No.: 16/845,519

(22) Filed: Apr. 10, 2020

(65) Prior Publication Data

US 2020/0326080 A1 Oct. 15, 2020

(30) Foreign Application Priority Data

Apr. 10, 2019 (KR) ..... 10-2019-0041936

(51) Int. Cl.
*F24F 1/0014* (2019.01)
*F24F 1/0018* (2019.01)
(Continued)

(52) U.S. Cl.
CPC ..... *F24F 1/0014* (2013.01); *F24F 1/0018* (2013.01); *F24F 1/0035* (2019.02);
(Continued)

(58) Field of Classification Search
CPC ..... F24F 1/0014; F24F 1/0018; F24F 1/0035; F24F 1/0038; F24F 13/082; F24F 1/0011; F24F 13/22; F24F 2013/221; F24F 13/08
(Continued)

(56) References Cited

U.S. PATENT DOCUMENTS 10,443,864 B2 10/2019 Yun et al.
10,823,433 B2 11/2020 Cho et al.
(Continued)

FOREIGN PATENT DOCUMENTS

CN 102853517 A 1/2013
CN 107449037 A 12/2017
(Continued)

OTHER PUBLICATIONS

Chinese Office Action dated Oct. 31, 2022 in Chinese Patent Application No. 202010279216.1 (8 pages: 12 pages English translation).

*Primary Examiner* — Steve S Tanenbaum
(74) *Attorney, Agent, or Firm* — Staas & Halsey LLP

(57) ABSTRACT

Disclosed is an air conditioner including a structure preventing dew from forming on a surface of a cabinet. The air conditioner includes a housing including an inlet through which air is introduced and an outlet through which air is discharged, a heat exchanger disposed between the inlet and the outlet, a blower disposed inside the housing to suck air through the inlet and to discharge air through the outlet, a discharge panel disposed in front of the housing which includes the outlet, the discharge panel including a plurality of holes through which air discharged from the outlet passes, and an airflow guide disposed between the discharge panel and the blower and configured to guide air discharged from the blower in at least two directions.

18 Claims, 11 Drawing Sheets

(51) Int. Cl.

| | |
|---|---|
| ***F24F 1/0038*** | (2019.01) |
| ***F24F 13/08*** | (2006.01) |
| ***F24F 1/0035*** | (2019.01) |
| ***F24F 13/20*** | (2006.01) |

(52) U.S. Cl.
CPC ..... *F24F 1/0038* (2019.02); *F24F 13/082* (2013.01); *F24F 2013/205* (2013.01)

(58) Field of Classification Search
USPC ..... 62/259.1
See application file for complete search history.

(56) References Cited

U.S. PATENT DOCUMENTS

| | | | | |
|---|---|---|---|---|
| 10,969,122 | B2 | 4/2021 | Kim et al. | |
| 2018/0216835 | A1 * | 8/2018 | Yun | F24F 13/08 |

FOREIGN PATENT DOCUMENTS

| | | | | |
|---|---|---|---|---|
| CN | 107850322 | A | 3/2018 | |
| CN | 208011912 | U | 10/2018 | |
| JP | 10-170043 | | 6/1998 | |
| JP | 2014-196882 | | 10/2014 | |
| KR | 10-0789820 | | 1/2008 | |
| KR | 10-2017-0020146 | | 2/2017 | |
| KR | 10-2018-0125425 | A | 11/2018 | |
| KR | 10-2018-0127223 | A | 11/2018 | |
| WO | WO 2017/014477 | A1 | 1/2017 | |
| WO | WO-2017014477 | A1 * | 1/2017 | F24F 1/00 |

* cited by examiner

AIR CONDITIONER INCLUDING AN AIRFLOW GUIDE TO GUIDE AIR BEING DISCHARGED

CROSS-REFERENCE TO RELATED APPLICATION(S)

This application is based on and claims priority under 35 U.S.C. § 119 to Korean Patent Application No. 10-2019-0041936, filed on Apr. 10, 2019, in the Korean Intellectual Property Office, the disclosure of which is incorporated by reference herein in its entirety.

BACKGROUND

1. Field

The disclosure relates to an air conditioner, and more particularly, to an air conditioner including a structure preventing dew from forming on a surface of a cabinet.

2. Description of Related Art

In general, an air conditioner is an apparatus that controls temperature, humidity, airflow, and distribution suitable for human activity using a refrigeration cycle. The refrigeration cycle is composed of a compressor, a condenser, an evaporator, an expansion valve, a blowing fan, and the like as main components.

The air conditioner may be classified into a separate type air conditioner in which an indoor unit and an outdoor unit are separately installed, and an integrated air conditioner in which an indoor unit and an outdoor unit are installed together in one cabinet. The indoor unit of the separate type air conditioner includes a heat exchanger for heat-exchanging air sucked into a panel, and a blowing fan for sucking air in a room into the panel and blowing the sucked air back into the room.

When being in direct contact with the air discharged from an indoor unit of a conventional air conditioner, a user may feel cold and discomfort, while when the being not in direct contact with the discharged air, the user may feel hot and discomfort. In order to reduce the discomfort of the user, air conditioners for discharging heat-exchanged air at a low speed through a plurality of holes have been disclosed.

In the case of an air conditioner that discharges heat-exchanged air at a low speed through a plurality of holes, dew may form on a portion of a panel in which the plurality of holes is provided. This may become a factor that lowers the reliability of the air conditioner.

SUMMARY

In accordance with an aspect of the disclosure, an air conditioner includes a housing including an inlet through which air is introduced and an outlet through which air is discharged, a heat exchanger disposed between the inlet and the outlet, a blower disposed inside the housing to suck air through the inlet and to discharge air through the outlet, a discharge panel disposed in the front of the housing in which the outlet is formed and including a plurality of holes through which air discharged from the outlet passes, and an airflow guide disposed between the discharge panel and the blower and configured to guide air such that air discharged from the blower is distributed in at least two directions.

The airflow guide may be configured to prevent dew from forming on the discharge panel by bringing air outside the discharge panel into contact with the discharge panel.

The airflow guide may guide air in an edge region of the discharge panel such that the air discharged from the blower moves from the inside of the discharge panel to the outside of the discharge panel through the plurality of holes.

The airflow guide may include, in order to distribute the air discharged from the blower to the left and right sides, a first guide portion extending to the left side with respect to the front of the housing, and a second guide portion extending to the right side with respect to the front of the housing from one end of the first guide portion.

The first guide portion may be provided longer than the second guide portion when the first guide portion extends to approach the center of an opening.

The second guide portion may be provided longer than the first guide portion when the second guide portion extends to approach the center of the opening.

The airflow guide may further include a rib provided between the first guide portion and the second guide portion to reinforce the rigidity of the airflow guide.

The blower may include a blowing fan to suck and discharge air, and a support panel including an opening corresponding to the blowing fan to discharge the air sucked by the blowing fan.

The airflow guide may be disposed on opposite sides of the front of the opening.

The airflow guide may be detachably coupled to the support panel.

The cross section of the airflow guide may be formed in a V shape.

The blowing fan may include a plurality of blowing fans arranged up and down.

The support panel may include a plurality of the openings corresponding to the plurality of blowing fans, respectively.

The airflow guides may be disposed on opposite sides of the front of at least one of the plurality of openings.

When a diameter of the opening is D and a length of the airflow guide in the up-down direction is H, a ratio H/D may be in a range of $0.8<H/D<1.3$.

When a diameter of the opening is D and the shortest distance in the front-rear direction between the opening and the airflow guide is L, a ratio L/D may be in a range of $0.07<L/D<0.11$.

The inlet may include a first inlet and a second inlet.

The outlet may include a first outlet formed in the housing to discharge air introduced from the first inlet, and a second outlet configured to allow the air introduced through the second inlet to be discharged to be mixed with the air discharged from the first outlet.

The blower may include a first blower configured to suck and discharge air through a first flow path formed between the first inlet and the first outlet, and a second blower formed between the second inlet and the second outlet and configured to suck and discharge air through a second flow path partitioned from the first flow path.

In accordance with another aspect of the disclosure, an air conditioner includes a housing including an inlet through which air is introduced and an outlet through which air is discharged, a heat exchanger disposed between the inlet and the outlet, a blowing fan disposed inside the housing to suck air through the inlet and to discharge air through the outlet, a fan case configured to fix the blowing fan to the inside of the housing and comprising an opening to discharge air sucked by the blowing fan, and an airflow guide extending in the up-down direction configured to guide air such that air discharged from the blower through the opening is distributed to the left and right sides, wherein the airflow guide is coupled to the fan case.

The air conditioner may further include a discharge panel disposed in the front of the housing in which the outlet is formed and comprising a plurality of holes through which air discharged from the outlet passes.

The airflow guide may include, in order to distribute the air discharged from the blowing fan through the opening to the left and right sides, a first guide portion extending to the left side with respect to the front of the housing, and a second guide portion extending to the right side with respect to the front of the housing from one end of the first guide portion.

The cross section of the airflow guide may be formed in a V shape.

The first guide portion may be provided longer than the second guide portion when the first guide portion extends to approach the center of the opening.

The second guide portion may be provided longer than the first guide portion when the second guide portion extends to approach the center of the opening.

The airflow guide may further include a plurality of ribs provided between the first guide portion and the second guide portion to reinforce the rigidity of the airflow guide and disposed to be spaced apart from each other in the up-down direction.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
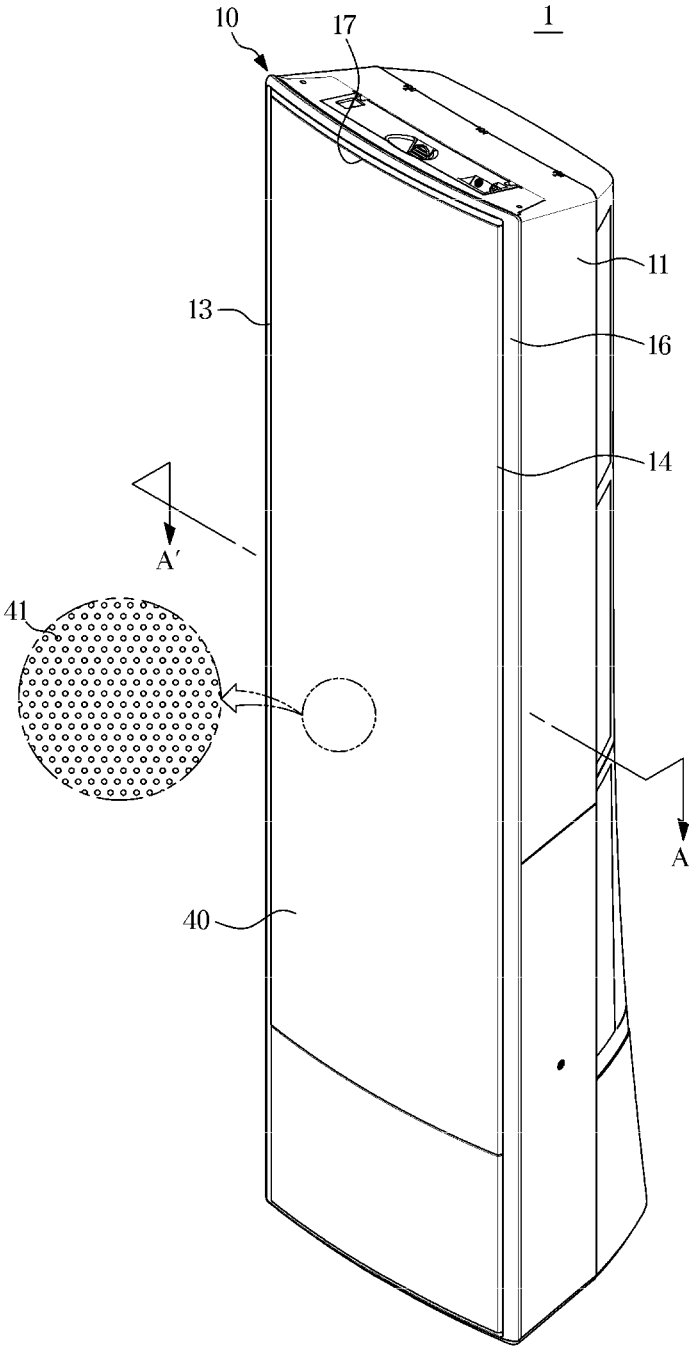
FIG. 1 illustrates an air conditioner according to an embodiment of the disclosure.

Configurations shown in the embodiments and the drawings described in the present specification are only the preferred embodiments of the disclosure, and thus it is to be understood that various modified examples, which may replace the embodiments and the drawings described in the present specification, are possible when filing the present application.

Like reference numbers or signs in the various drawings of the application represent parts or components that perform substantially the same functions.

The terms used in the present specification are used to describe the embodiments of the disclosure. Accordingly, it should be apparent to those skilled in the art that the following description of exemplary embodiments of the disclosure is provided for illustration purpose only and not for the purpose of limiting the disclosure as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that although the terms first, second, etc. may be used herein to describe various components, these components should not be limited by these terms, and the terms are only used to distinguish one component from another. For example, without departing from the scope of the disclosure, the first component may be referred to as a second component, and similarly, the second component may also be referred to as a first component. The term "and/or" includes any combination of a plurality of related items or any one of a plurality of related items.

In this specification, the terms "front," "rear," "upper" "lower," "left," and "right" are defined with reference to the drawings, and the shape and position of each component are not limited by these terms.

It is an aspect of the disclosure to provide an air conditioner including a structure preventing dew from forming on a surface of a cabinet.

It is an aspect of the disclosure to provide an air conditioner guiding air discharged from a blowing fan such that air outside a discharge panel does not flow into the discharge panel in an edge region of the discharge panel including a plurality of holes.

A refrigeration cycle of an air conditioner is composed of a compressor, a condenser, an expansion valve, and an evaporator. A refrigerant undergoes a series of processes comprising of compression, condensation, expansion, and evaporation, and a high temperature air is heat exchanged with a low temperature refrigerant to become a low temperature air and supplied to a room.

The compressor compresses a refrigerant gas to a high temperature and high pressure and then discharges the high temperature and high pressure gas, and the discharged refrigerant gas is introduced into the condenser. The condenser condenses the compressed refrigerant into a liquid phase and radiates heat to surroundings through the condensation process.

The expansion valve expands a high temperature and high pressure liquid refrigerant condensed in the condenser into a low pressure liquid refrigerant. The evaporator evaporates the refrigerant expanded in the expansion valve and returns a low temperature and low pressure refrigerant gas to the compressor. The evaporator uses the latent heat of evaporation of a refrigerant to achieve a cooling effect by heat exchange with an object to be cooled. Through this cycle, an air temperature of an indoor space may be controlled.

An outdoor unit of an air conditioner refers to a device comprising of a compressor and an outdoor heat exchanger in a refrigeration cycle. An indoor unit of an air conditioner includes an indoor heat exchanger, and an expansion valve may be disposed in either an indoor unit or the outdoor unit of the air conditioner. The indoor heat exchanger and the outdoor heat exchanger function as a condenser or an evaporator. When the indoor heat exchanger is used as a condenser, the air conditioner becomes a heater, and when the indoor heat exchanger is used as an evaporator, the air conditioner becomes a cooler.

Hereinafter, embodiments of the disclosure will be described in detail with reference to the accompanying drawings.

Figure 2:
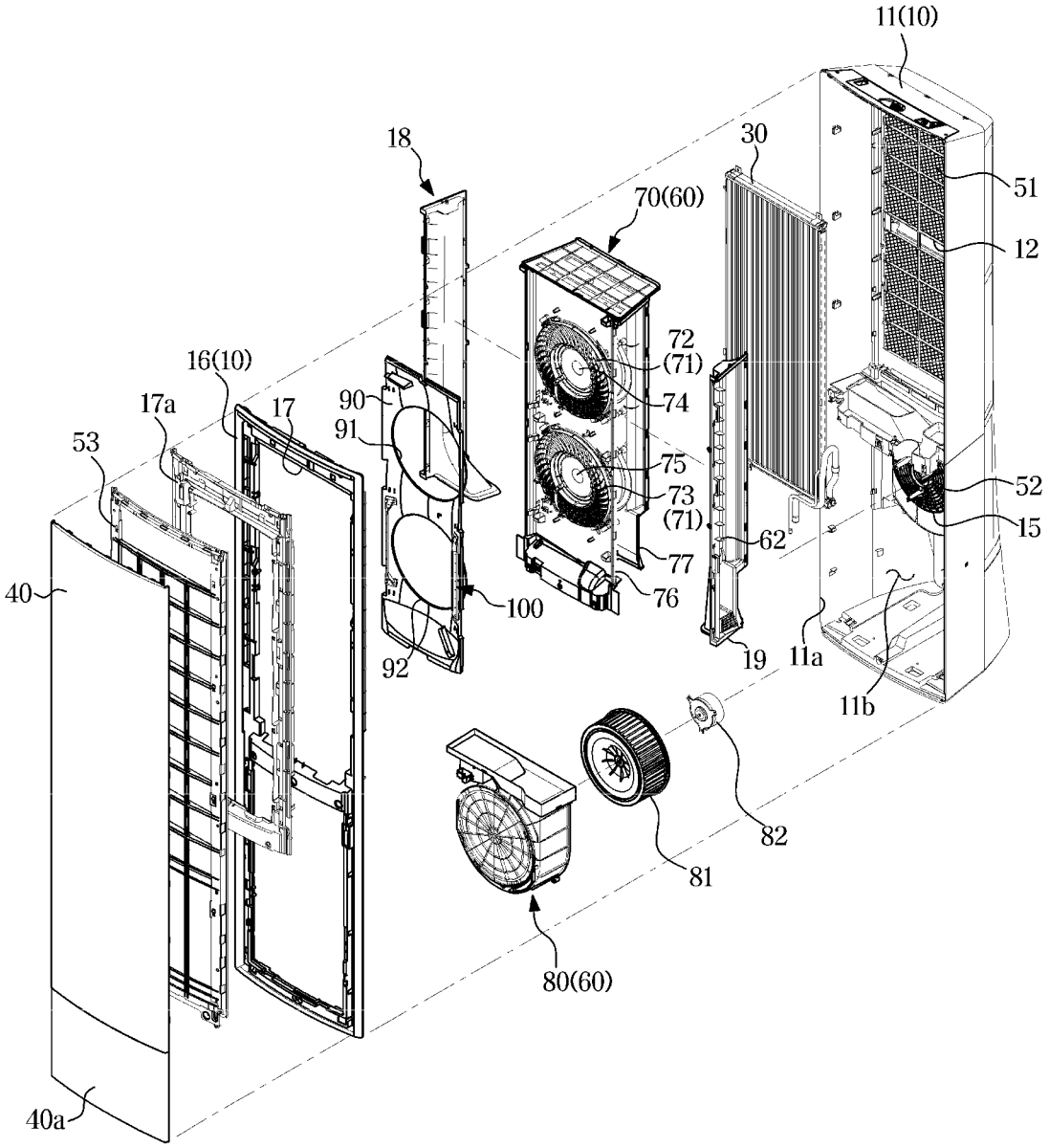
FIG. 2 is an exploded perspective view of the air conditioner illustrated in FIG. 1.
Figure 3:
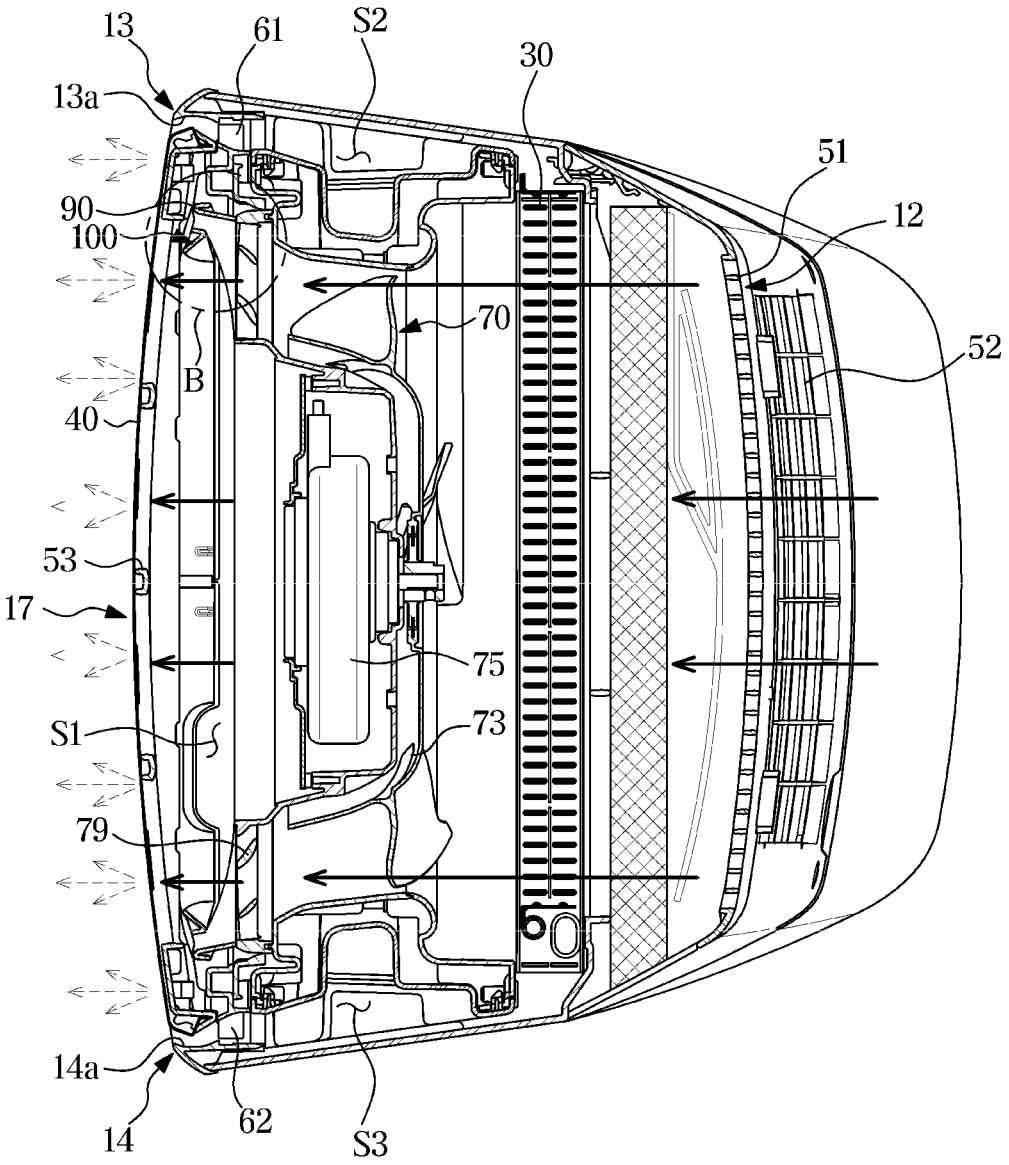
FIG. 3 is a cross-sectional view taken along line A-A' in FIG. 1 when the air conditioner illustrated in FIG. 1 operates in a first mode.
Figure 4:
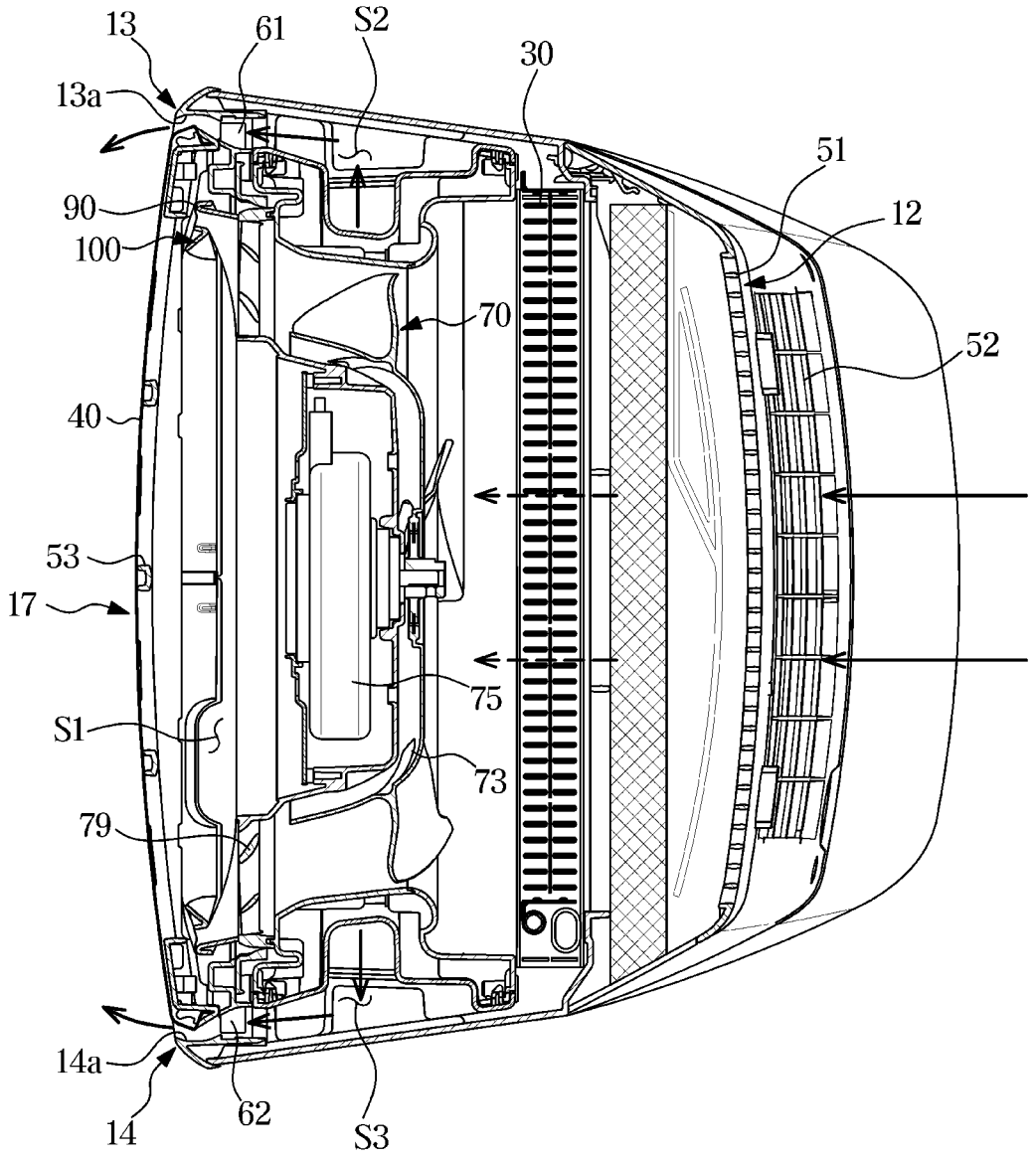
FIG. 4 is a cross-sectional view taken along line A-A' in FIG. 1 when the air conditioner illustrated in FIG. 1 operates in a second mode.
Figure 5:
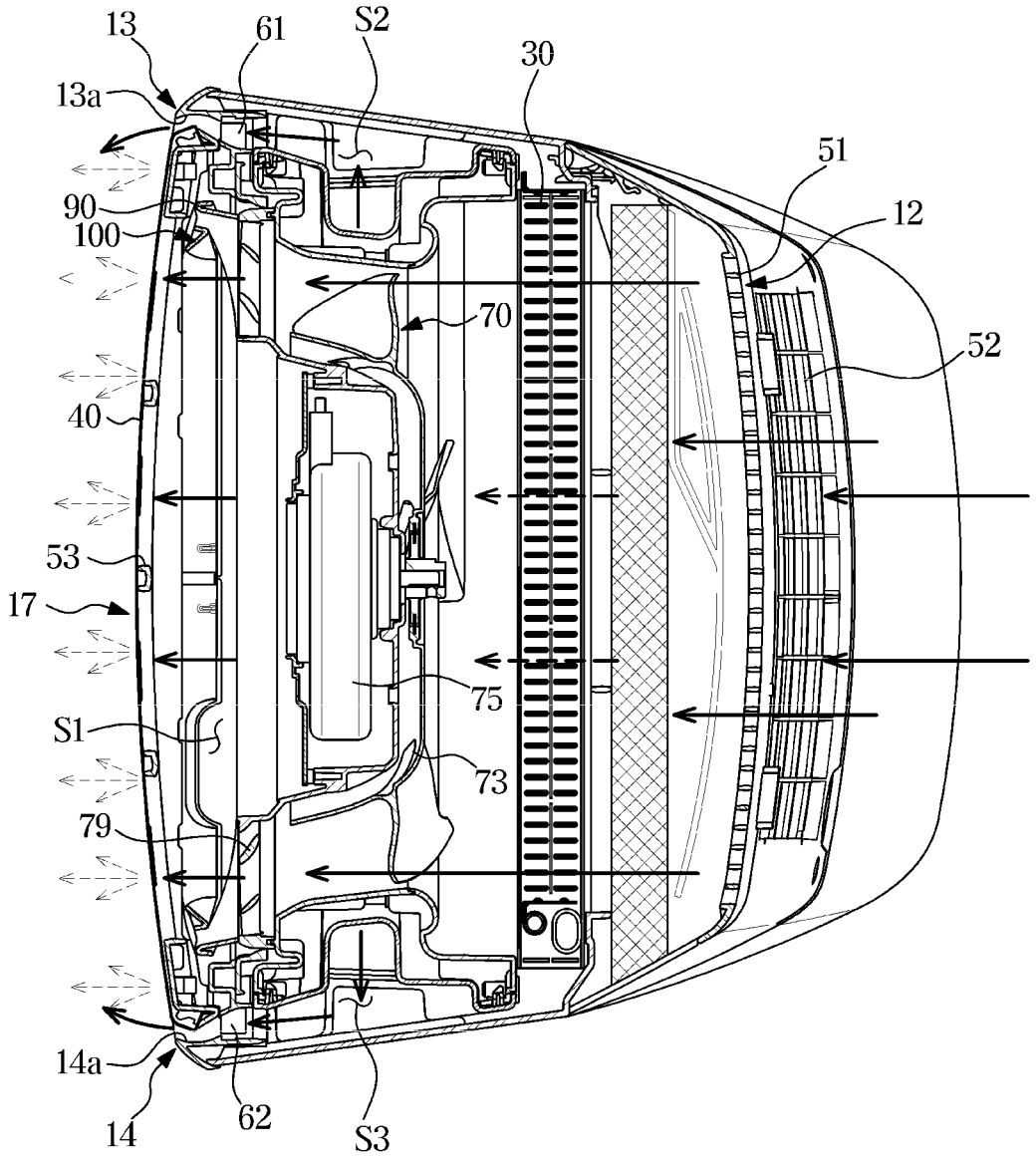
FIG. 5 is a cross-sectional view taken along line A-A' in FIG. 1 when the air conditioner illustrated in FIG. 1 operates in a third mode.

FIG. 1 illustrates an air conditioner according to an embodiment of the disclosure. FIG. 2 is an exploded perspective view of the air conditioner illustrated in FIG. 1. FIG. 3 is a cross-sectional view taken along line A-A' in FIG. 1 when the air conditioner illustrated in FIG. 1 operates in a first mode. FIG. 4 is a cross-sectional view taken along line A-A' in FIG. 1 when the air conditioner illustrated in FIG. 1 operates in a second mode. FIG. 5 is a cross-sectional view taken along line A-A' in FIG. 1 when the air conditioner illustrated in FIG. 1 operates in a third mode.

Referring to FIGS. 1 and 2, an air conditioner 1 may include a housing 10 forming an outer appearance, a blower 60 to circulate air to the inside or outside of the housing 10, and a heat exchanger 30 to exchange heat with air introduced into the housing 10.

The housing 10 may include a body case 11 in which the blower 60 and the heat exchanger 30 are mounted, and a front panel 16 covering a front surface of the body case 11. The housing 10 may include a first inlet 12, a second inlet 15, a main outlet 17, and guide outlets 13 and 14.

The body case 11 may form a rear surface, opposite side surfaces, an upper surface and a lower surface of the air conditioner 1. The body case 11 has an open front surface, the open front surface may form a body case opening 11*a*, and the body case opening 11*a* may be covered by the front panel 16 and a discharge panel 40.

The front panel 16 may be coupled to the body case opening 11*a*. FIG. 2 illustrates that the front panel 16 is detachably provided from the body case 11, but the front panel 16 and the body case 11 may be integrally formed.

A main outlet 17 may be formed on the front panel 16. The main outlet 17 may be disposed on the front surface of the housing 10. The main outlet 17 may penetrate the front panel 16. The main outlet 17 may be formed at an upper portion of the front panel 16. The main outlet 17 may be disposed at a position substantially facing the first inlet 12. Air heat exchanged inside the housing 10 may be discharged to the outside of the housing 10 through the main outlet 17. The main outlet 17 may allow to air introduced through the first inlet 12 to be discharged.

A panel support member 17*a* supporting the discharge panel 40 may be formed at a portion of the front panel 16 on which the main outlet 17 is formed. The panel support member 17*a* may extend along a circumference of the main outlet 17. The panel support member 17*a* may support a rear surface of the discharge panel 40.

A plurality of holes 41 may be formed on the discharge panel 40. The plurality of holes 41 may be formed to penetrate the discharge panel 40. The plurality of holes 41 may be formed on the entire region except for a blocking portion 40*a* (see FIG. 2) of the discharge panel 40. The discharge panel 40 may include the blocking portion 40*a* on which the plurality of holes 41 are not formed.

The first inlet 12 may be formed on the body case 11. The first inlet 12 may penetrate a rear surface of the body case 11. The first inlet 12 may be formed at an upper portion of the rear surface of the body case 11. Outside air may be introduced into the housing 10 through the first inlet 12.

Although FIG. 2 illustrates that two of the first inlets 12 are provided, the number of the first inlets 12 is not limited thereto and may be variously provided as needed. Although FIG. 2 illustrates that the first inlet 12 is formed in a quadrangular shape, the shape of the first inlet 12 is not limited thereto and may be variously formed as needed.

The second inlet 15 may be formed on the body case 11. The second inlet 15 may penetrate the rear surface of the body case 11. The second inlet 15 may be formed at a lower portion of the rear surface of the body case 11. The second inlet 15 may be formed below the first inlet 12. Outside air may be introduced into the housing 10 through the second inlet 15.

Like the first inlet 12, the number and/or shape of the second inlets 15 may be variously provided as needed.

The front panel 16 may form the guide outlets 13 and 14 together with the discharge panel 40. The guide outlets 13 and 14 may be formed on the same plane as the main outlet 17. The guide outlets 13 and 14 may be formed on the left and/or right side of the main outlet 17. The guide outlets 13 and 14 may be disposed adjacent to the main outlet 17. The guide outlets 13 and 14 may be disposed to be spaced apart from the main outlet 17 by a predetermined distance. The guide outlets 13 and 14 may include the first guide outlet 13 disposed on the left side of the main outlet 17 and the second guide outlet 14 disposed on the right side of the main outlet 17.

The guide outlets 13 and 14 may extend along the up-down direction of the body case 11. The guide outlets 13 and 14 may have a length approximately equal to a length of the main outlet 17. Air that is not heat exchanged inside the housing 10 may be discharged to the outside of the housing 10 through the guide outlets 13 and 14. The guide outlets 13 and 14 may be provided to allow air introduced through the second inlet 15 to be discharged.

The guide outlets 13 and 14 may be configured to allow air discharged from the guide outlets 13 and 14 to be mixed with air discharged from the main outlet 17. In detail, a portion of the front panel 16 forming the guide outlets 13 and 14 may be provided with guide curved portions 13*a* and 14*a* (see FIG. 3) to guide air discharged from the guide outlets 13 and 14 such that the air discharged from the guide outlets 13 and 14 is mixed with the air discharged from the main outlet 17.

Air to be discharged through the guide outlets 13 and 14 may be discharged along the guide curved portions 13*a* and 14*a* in a direction that may be mixed with the air discharged from the main outlet 17. The guide curved portions 13*a* and 14*a* may guide the air discharged through the guide outlets 13 and 14 to be discharged in approximately the same direction as the air discharged through the main outlet 17. The guide curved portions 13*a* and 14*a* may be provided to guide the air discharged through the guide outlets 13 and 14 to the front.

The guide outlets 13 and 14 may be provided with blades 61 and 62 (see FIG. 3) to guide air discharged through the guide outlets 13 and 14. The blades 61, 62 may be arranged continuously along a length direction of the guide outlets 13 and 14. The first blade 61 may be disposed on the first guide outlet 13, and the second blade 62 may be disposed on the second guide outlet 14.

A flow path of air connecting the first inlet 12 and the main outlet 17 will be referred to as a first flow path S1, a flow path of air connecting the second inlet 15 and the first guide outlet 13 will be referred to as a second flow path, and a flow path of air connecting the second inlet 15 and the second guide outlet 14 will be referred to as a third flow path S3. The first flow path S1 may be partitioned from the second flow path S2 and the third flow path S3. Accordingly, air flowing through the first flow path S1 may not be mixed with air flowing through the second flow path S2 and the third flow path S3. The second flow path S2 and the third flow path S3 may overlap each other in some sections. In detail, the second flow path S2 and the third flow path S3 may be common in a section from the second inlet 15 to a second blower 80.

A first duct 18 may be disposed in the housing 10 to partition the first flow path S1 and the second flow path S2. The first duct 18 may be disposed on the left side of a first blower 70. The first duct 18 may extend in the up-down direction. The first duct 18 may be in communication with the second blower 80. The first duct 18 may guide a part of air blown by the second blower 80 to the first guide outlet 13. The first duct 18 may be provided with a first duct filter (not shown) to filter out foreign matters from air introduced from the second blower 80.

A second duct 19 may be disposed in the housing 10 to partition the first flow path S1 and the third flow path S3. The second duct 19 may be disposed on the right side of a first blower 70. The second duct 19 may extend in the up-down direction. The second duct 19 may be in communication with the second blower 80. The second duct 19 may guide a part of air blown by the second blower 80 to the second guide outlet 14. The second duct 19 may be provided with a second duct filter (no drawing number) to filter out foreign matters from air introduced from the second blower 80.

The air conditioner 1 allows air heat exchanged with the heat exchanger 30 through the main outlet 17 to be discharged and may allow air not passed through the heat exchanger 30 to be discharged through the guide outlets 13 and 14. That is, the guide outlets 13 and 14 may be provided to discharge air that is not heat exchanged. Because the heat exchanger 30 is disposed on the first flow path S1, air discharged through the main outlet 17 may be air that is heat exchanged. Because no heat exchanger is disposed on the second flow path S2 and the third flow path S3, air discharged through the guide outlets 13 and 14 may be air that is not heat exchanged.

On the other hand, the disclosure may be provided to discharge the heat exchanged air through the guide outlets 13 and 14. That is, a heat exchanger may also be disposed on the second flow path S2 and the third flow path S3. Specifically, a heat exchanger for heat exchanging air to be discharged through the guide outlets 13 and 14 may be disposed in an accommodation space 11*b* of the body case 11. Through this configuration, the air conditioner 1 may provide heat exchanged air through both the main outlet 17 and the guide outlets 13 and 14.

The body case 11 may have a shape in which a cross section with respect to a horizontal direction becomes wider toward a lower side thereof. According to this shape, the housing 10 may be stably supported with respect to the floor.

The accommodation space 11*b* in which electrical components (not shown) may be arranged may be formed in the body case 11. The electrical components necessary for the operation of the air conditioner 1 may be arranged in the accommodation space 11*b*. The second blower 80 may be disposed in the accommodation space 11*b*.

The blower 60 may include the first blower 70 and the second blower 80. The second blower 80 may be provided to be driven independently of the first blower 70. A rotational speed of the second blower 80 may be provided to be different from a rotational speed of the first blower 70.

The first blower 70 may be disposed on the first flow path S1 formed between the first inlet 12 and the main outlet 17. Air may be introduced into the housing 10 through the first inlet 12 by the first blower 70. The air introduced through the first inlet 12 may move along the first flow path S1 and be discharged to the outside of the housing 10 through the main outlet 17. The first blower 70 may include a plurality of first blowing fans 71 disposed up and down. The first blower 70 may include first fan drivers 74 and 75 driving the plurality of first blowing fans 72 and 73, respectively.

The first blowing fan 71 may be an axial fan or a diagonal fan. However, the type of the first blowing fan 71 is not limited thereto, and it is sufficient that the first blowing fan 71 is configured such that air introduced from the outside of the housing 10 may be discharged back to the outside of the housing 10. For example, the first blowing fan 71 may be a cross fan, a turbo fan, or a sirocco fan.

FIG. 2 illustrates that two of the first blowing fans 71 are provided, but the number of first blowing fans 71 is not limited thereto, and various numbers of the first blowing fans 71 may be provided as needed.

The first fan drivers 74 and 75 may drive the first blowing fans 71. The first fan drivers 74 and 75 may be disposed at central portions of the first blowing fans 71. The first fan drivers 74 and 75 may include a motor.

The second blower 80 may be disposed on the second flow path S2 and the third flow path S3 formed between the second inlet 15 and the guide outlets 13 and 14. Air may be introduced into the housing 10 through the second inlet 15 by the second blower 80. A part of the air introduced through the second inlet 15 may move along the second flow path S2 and be discharged to the outside of the housing 10 through the first guide outlet 13 or may move along the third flow path S3 and be discharged to the outside of the housing 10 through the second guide outlet 14.

The second blower 80 may include a second blowing fan 81 and a second fan driver 82.

The second blowing fan 81 may be a centrifugal fan. However, the type of the second blowing fan 81 is not limited thereto, and it is sufficient that the second blowing fan 81 is configured such that air introduced from the outside of the housing 10 may be discharged back to the outside of the housing 10. For example, the second blowing fan 81 may be a cross fan, a turbo fan, or a sirocco fan.

FIG. 2 illustrates that one of the second blowing fan 81 is provided, but the number of second blowing fans 81 is not limited thereto, and various numbers of the second blowing fans 81 may be provided as needed.

The second fan driver 82 may drive the second blowing fan 81. The second fan driver 82 may be disposed at a central portion of the second blowing fan 81. The second fan driver 82 may include a motor.

The heat exchanger 30 may be disposed between the first blower 70 and the first inlet 12. The heat exchanger 30 may be disposed on the first flow path S1. The heat exchanger 30 may absorb heat from the air introduced through the first inlet 12 or transfer heat to the air introduced through the first inlet 12. The heat exchanger 30 may include tubes and headers coupled to the tubes. However, the type of heat exchanger 30 is not limited thereto.

The air conditioner 1 may include the discharge panel 40 disposed at a portion of the front panel 16 on which the main outlet 17 is formed. The discharge panel 40 may have the plurality of holes 41 (see FIG. 1) to allow air discharged from the main outlet 17 to be discharged slower than air discharged from the guide outlets 13 and 14. The plurality of holes 41 may penetrate the inner and outer surfaces of the discharge panel 40. The plurality of holes 41 may penetrate the inner and outer surfaces of the discharge panel 40. The plurality of holes 41 may be formed in a minute size. The plurality of holes 41 may be uniformly distributed over the entire area of the discharge panel 40. The heat exchanged air discharged through the main outlet 17 may be uniformly discharged at a low speed by the plurality of holes 41. The blocking portion 40*a* on which the plurality of holes 41 is not formed may be provided at a lower end of the discharge panel 40.

The air conditioner 1 may include a first suction grill 51 coupled to a portion on which the first inlet 12 of the body case 11 is formed. The first suction grill 51 may be provided such that foreign matters are not introduced through the first inlet 12. To this end, the first suction grill 51 may include a plurality of slits or holes. The first suction grill 51 may be provided to cover the first inlet 12.

The air conditioner 1 may include a second suction grill 52 coupled to a portion on which the second inlet 15 of the body case 11 is formed. The second suction grill 52 may be provided such that foreign matters are not introduced through the second inlet 15. To this end, the second suction grill 52 may include a plurality of slits or holes. The second suction grill 52 may be provided to cover the second inlet 15.

The air conditioner 1 may include a discharge grill 53 coupled to a portion on which the first outlet 17 of the front panel 16 is formed. The discharge grill 53 may be mounted to the panel support member 17*a*. The discharge grill 53 may be provided such that foreign matters are not discharged through the first outlet 17. To this end, the discharge grill 53 may include a plurality of slits or holes. The discharge grill 53 may be provided to cover the first outlet 17.

Hereinafter, the operation of the air conditioner 1 will be described with reference to FIGS. 3 to 5.

Referring to FIG. 3, the air conditioner 1 may operate in a first mode for discharging heat exchanged air through only the main outlet 17. Because the discharge panel 40 is disposed on the main outlet 17, air conditioning may be slowly performed throughout a room. That is, when air is discharged to the outside of the housing 10 through the main outlet 17, the air may be discharged at a low speed as a wind speed thereof is reduced while passing through the plurality of holes 41 of the discharge panel 40. According to this configuration, the room may be cooled or heated at a wind speed that provides comfort to the user.

Specifically, as the first blower 70 is driven, outside air of the housing 10 may be introduced into the housing 10 through the first inlet 12. The air introduced into the housing 10 may be heat exchanged through the heat exchanger 30. The heat exchanged air passed through the heat exchanger 30 passes through the first blower 70 and the discharge panel 40 and may be discharged to the outside of the housing 10 through the main outlet 17 in a reduced speed. That is, the heat exchanged air discharged through the first flow path S1 may be discharged at a wind speed at which the user may feel comfortable.

Because the second blower 80 is not driven in the first mode, no air is discharged through the guide outlets 13 and 14.

Referring to FIG. 4, the air conditioner 1 may operate in a second mode for discharging air, which is not heat exchanged, through only the guide outlets 13 and 14. Because no heat exchanger is disposed on the second flow path S2 and the third flow path S3, the air conditioner 1 may circulate indoor air.

Because the guide curved portions 13*a* and 14*a* are provided on the guide outlets 13 and 14, the air discharged through the guide outlets 13 and 14 may be discharged to the front of the air conditioner 1. Because the blades 61 and 62 are provided on the guide outlets 13 and 14, the air may be blown farther toward the front.

Specifically, as the second blower 80 is driven, outside air of the housing 10 may be introduced into the housing 10 through the second inlet 15. The air introduced into the housing 10 may pass through the second blower 80 and then move to the second flow path S2 and the third flow path S3 formed on opposite sides of the first flow path S1, respectively. The air may move upward in the second flow path S2 and the third flow path S3 and then may be discharge to the outside of the housing 10 through the guide outlets 13 and 14. In this case, the air may be guided toward the front of the air conditioner 1 along the guide curved portions 13*a* and 14*a*.

Because the first blower 70 is not driven in the second mode, no air is discharged through the main outlet 17. That is, because the air conditioner 1 blows air that is not heat exchanged in the second mode, the air conditioner 1 may simply perform a function of circulating indoor air or provide a strong wind to the user.

Referring to FIG. 5, the air conditioner 1 may operate in a third mode for discharging heat exchanged air through the main outlet 17 and the guide outlets 13 and 14. The air conditioner 1 may discharge cold air farther when operating in the third mode than when operating in the first mode.

Specifically, when the air conditioner 1 operates in the third mode, cold air or warm air discharged through the main outlet 17 and air discharged through the guide outlets 13 and 14 may be mixed. In addition, because the air discharged through the guide outlets 13 and 14 is discharged at a higher speed than the air discharged through the main outlet 17, the air discharged through the guide outlets 13 and 14 may move the heat exchanged air discharged through the main outlet 17 further away.

According to this configuration, the air conditioner 1 may provide the user with comfortable cold or warm air in which the heat exchanged air and indoor air are mixed.

The air conditioner 1 may be configured to provide cold air to various distances by changing a driving force of the first blower 70 and/or the second blower 80. That is, the first blower 70 may be configured to be capable of adjusting the air flow rate and/or air speed of air discharged through the main outlet 17, and the second blower 80 may be configured to be capable of adjusting the air flow rate and/or air speed of air discharged through the guide outlets 13 and 14.

For example, when increasing the driving force of the second blower 80 to increase the air flow rate and/or air speed of air discharged from the guide outlets 13 and 14, the air conditioner 1 may move the heat exchanged air further away. On the other hand, when decreasing the driving force of the second blower 80 to decrease the air flow rate and/or air speed of air discharged from the guide outlets 13 and 14, the air conditioner 1 may provide the heat exchanged air to a relatively short distance.

Figure 6:
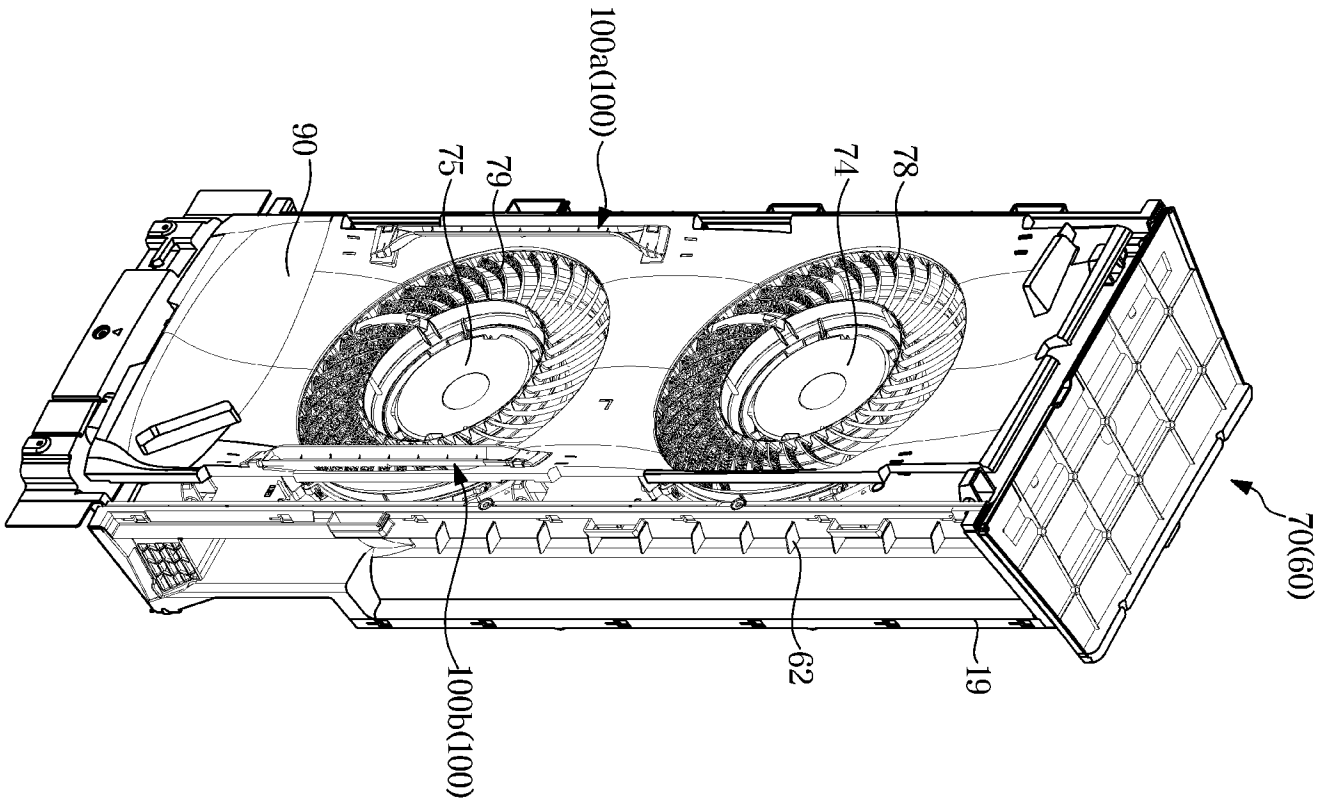
FIG. 6 illustrates a first blower in the air conditioner according to an embodiment of the disclosure.
Figure 7:
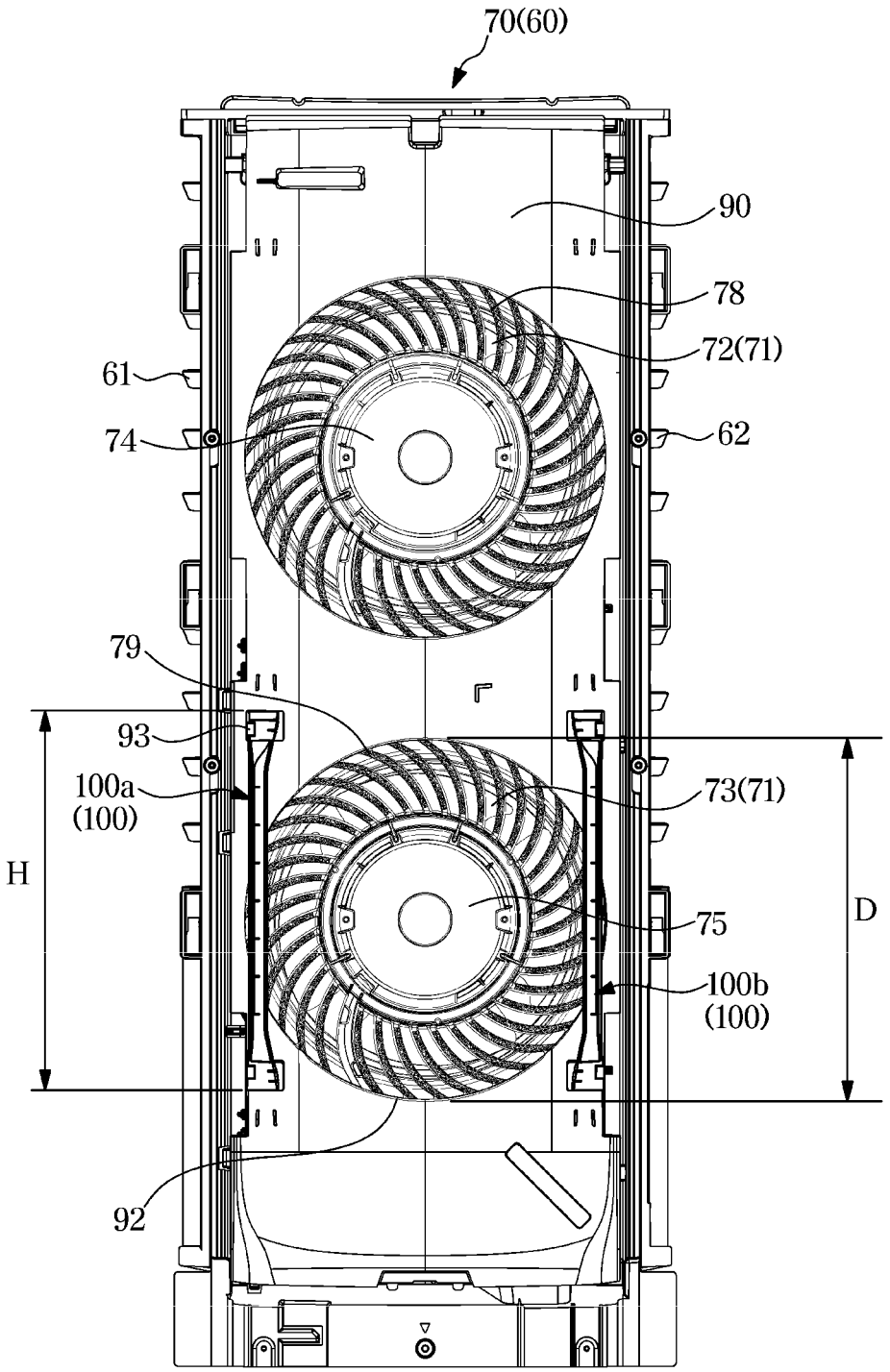
FIG. 7 is a front view of the first blower illustrated in FIG. 6.
Figure 8:
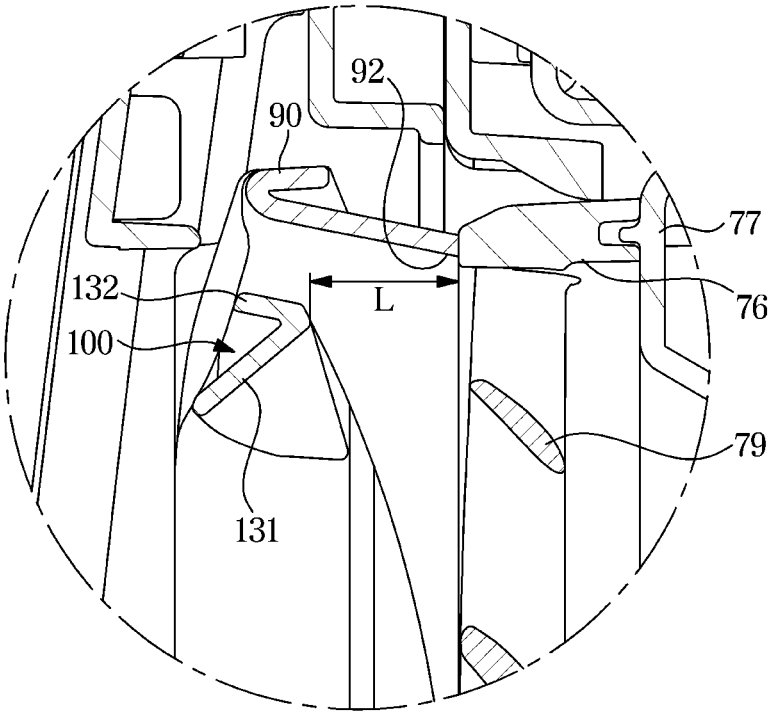
FIG. 8 is an enlarged view of a portion B illustrated in FIG. 3.
Figure 9:
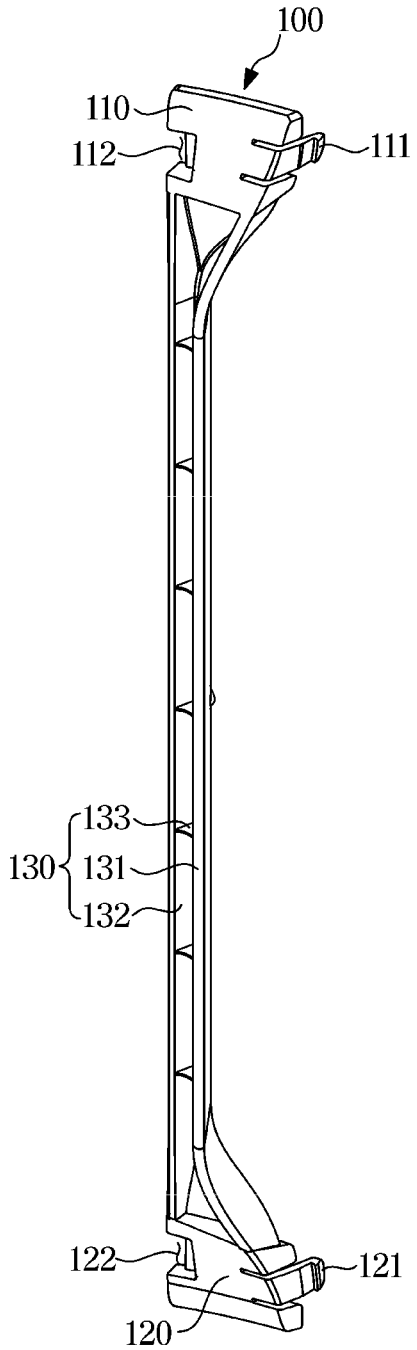
FIG. 9 illustrates an airflow guide in the air conditioner according to an embodiment of the disclosure.

FIG. 6 illustrates a first blower in the air conditioner according to an embodiment of the disclosure. FIG. 7 is a front view of the first blower illustrated in FIG. 6. FIG. 8 is an enlarged view of a portion B illustrated in FIG. 3. FIG. 9 illustrates an airflow guide in the air conditioner according to an embodiment of the disclosure.

Hereinafter, the structure and the effect of an airflow guide according to an embodiment of the disclosure will be described in detail. The content overlapping with the above will be omitted.

Referring to FIG. 6, the first blower 70 may include the plurality of first blowing fans 71 and fan cases 76 and 77 (see FIG. 2) to fix the plurality of first blowing fans 71 to the inside of the housing 10.

The plurality of first blowing fans 71 may include a first-a blowing fan 72 and a first-b blowing fan 73, which are disposed up and down.

The fan cases 76 and 77 may include the first fan case 76 coupled from the front of the plurality of first blowing fans 71 and the second fan case 77 coupled from the rear of the plurality of first blowing fans 71.

A support panel 90 may be coupled to the front of the fan cases 76 and 77. The support panel 90 may include a plurality of openings 91 and 92 (see FIG. 2).

The support panel 90 may be detachably coupled with respect to the fan cases 76 and 77. Alternatively, the support panel 90 may be integrally formed with the fan cases 76 and 77.

Air sucked from each of the plurality of first blowing fans 71 may be discharged forward through the plurality of openings 91 and 92, respectively. Spiral grills 78 and 79 may be formed in the first fan case 76 to spirally guide the air discharged from the plurality of first blowing fans 71.

According to an embodiment of the disclosure, the first blower 70 may include an airflow guide 100 configured to guide air discharged from the first blowing fan 71 to prevent dew from forming on the discharge panel 40.

When the air conditioner operates in the first mode, the flow of air in the front of the discharge panel may be varied by various variables such as a ratio of a length of the first blower or the air conditioner in the left-right direction to a length in the up-down direction.

In particular, in some regions in the front of the discharge panel, hot and humid outside air may move toward and bring into contact with the discharge panel. That is, air outside the discharge panel may be induced to move toward the discharge panel and to bring into contact with the discharge panel. This phenomenon will be expressed herein as the occurrence of negative pressure or low pressure in the front of the discharge panel.

When negative pressure or low pressure occurs in the front of the discharge panel, as described above, air outside the discharge panel moves toward the inside of the discharge panel, and in this process, the air outside the discharge panel brings into contact with the discharge panel.

The air outside the discharge panel is relatively hot and high humid air, the air inside the discharge panel is relatively cold and low humidity air through the heat exchanger, and a temperature of the discharge panel is lowered by this cold air. In this state, when the hot and high humid air outside the discharge panel brings into contact with the discharge panel of a cold state, dew forms on the discharge panel. That is, dew condensation occurs on a surface of the discharge panel. In other words, dew condensation occurs on a surface of a cabinet of the air conditioner. When dew continues to form, dew flows along the surface of the air conditioner and accumulates inside or outside the air conditioner, which may adversely affect both hygiene and safety. This may also lower the reliability of the product.

Therefore, there is a need for a method of eliminating this dew condensation phenomenon. According to an embodiment of the disclosure, the generation of negative or low pressure in the front of the discharge panel 40 may be prevented by providing the airflow guide 100, and through this, dew may be prevented from forming on the surface of the discharge panel 40.

The airflow guide 100 may guide air in an edge region of the discharge panel 40 such that the air discharged from the first blowing fan 71 moves from the inside of the discharge panel 40 to the outside of the discharge panel 40 through the plurality of holes 41. The movement of air from the inside of the discharge panel 40 to the outside of the discharge panel 40 through the plurality of holes 41 means that air flows from the inside of the discharge panel 40 to the outside. When air flows from the inside of the discharge panel 40 to the outside, negative pressure or low pressure is not generated in the front of the discharge panel 40. On the contrary, when negative pressure or low pressure is generated in the front of the discharge panel 40, air flows from the outside of the discharge panel 40 to the inside. The airflow guide 100 may guide air in the edge region of the discharge panel 40 such that the air flows from the inside of the discharge panel 40 to the outside.

Referring to FIGS. 6 and 7, the airflow guide 100 may be disposed on opposite sides in the front of the lower opening 92 of the plurality of openings 91 and 92. A pair of airflow guides 100*a* and 100*b* disposed on the opposite sides in the front of the opening 92 may have the same shape but may be symmetrical with each other.

The airflow guide 100 may extend in the up-down direction to distribute air discharged from the first-b blowing fan 73 through the opening 92 to the left and right sides. The airflow guide 100 may include a first guide portion 131 (see FIG. 8) extending in a direction approaching a rotation axis of the first-b blowing fan 73, and a second guide portion 132 (see FIG. 8) extending from one end of the first guide portion 131 in a direction away from the rotation axis of the first-b blowing fan 73. The first guide portion 131 and the second guide portion 132 may extend toward the front of the first-b blowing fan 73, respectively. As illustrated in FIG. 8, the first guide portion 131 and the second guide portion 132 may be provided to have different lengths. The rotation axis of the first-b blowing fan 73 may indicate a virtual line passing through the center of the opening 92.

The lengths of the first guide portion 131 and the second guide portion 132 are different from each other, but when the first guide portion 131 extends to approach the rotation axis of the first-b blowing fan 73, the first guide portion 131 may be provided to be longer than the second guide portion 132. On the contrary, when the second guide portion 132 extends to approach the rotation axis of the first-b blowing fan 73, the second guide portion 132 may be provided to be longer than the first guide portion 131.

Referring to FIG. 8, the airflow guide 100 may include the first guide portion 131 extending in the direction approaching the rotation axis of the first-b blowing fan 73, and the second guide portion 132 extending in the direction away from the rotation axis of the first-b blowing fan 73. Because the first guide portion 131 extends to approach the rotation axis of the first-b blowing fan 73, as illustrated in FIG. 8, the length of the first guide portion 131 may be longer than the length of the second guide portion 132. As such, when the length of the first guide portion 131 is longer than the length of the second guide portion 132, air guided by the second guide portion 132 having a shorter length not only moves in the front of the airflow guide 100, but also causes a vortex in a recess formed between the first guide portion 131 and the second guide portion 132. Due to this vortex, negative pressure or low pressure is not generated in the edge region of the discharge panel 40, and dew may be prevented from forming on the surface of the discharge panel 40. In this case, the recess formed between the first guide portion 131 and the second guide portion 132 may indicate a predetermined space in which a rib 133, which will be described later, is provided.

When the lengths of the first guide portion 131 and the second guide portion 132 are the same, no vortex occurs in the recess formed between the first guide portion 131 and the second guide portion 132, and thus dew may form on the edge region of the discharge panel 40 corresponding to the airflow guide 100. Similarly, when the length of the first guide portion 131 is shorter than the length of the second guide portion 132, no vortex occurs in the recess formed between the first guide portion 131 and the second guide portion 132, and thus dew may form on the edge region of the discharge panel 40 corresponding to the airflow guide 100. Referring to FIG. 7, a diameter of the opening 92 is referred to as D, and a length of the airflow guide 100 in the up-down direction is referred to as H. Hereinafter, the length of the airflow guide 100 in the up-down direction may be expressed as a height of the airflow guide.

When the diameter of the opening 92 is D and the height of the airflow guide 100 is H, a ratio H/D of the height H of the airflow guide 100 to the diameter D of the opening 92 satisfies $0.8<H/D<1.3$. In other words, the height H of the airflow guide 100 may be provided larger than 0.8 times and smaller than 1.3 times the diameter D of the opening 92. As such, the reason why the range of the height H of the airflow guide 100 is set for the diameter D of the opening 92 is as follows. When the height H of the airflow guide 100 is too smaller than the diameter D of the opening 92, the air guide effect of the airflow guide 100 is weakened, so that dew formation on the discharge panel 40 may not be effectively prevented. Also, when the height H of the airflow guide 100 is too larger than the diameter D of the opening 92, although not illustrated in FIG. 7, one of the first blowing fan 71 and a pair of the airflow guides 100 are not easily modularized and manufactured. That is, a height of a module including one of the first blowing fan 71 and a pair of the airflow guides 100 becomes excessively large.

Referring to FIG. 8, when the diameter of the opening 92 is D and the shortest distance in the front-rear direction between the airflow guide 100 and the opening 92 is L, a ratio L/D of the shortest distance to the diameter of the opening 92 satisfies $0.07<L/D<0.11$. As such, the reason why the range of the shortest distance L between the opening 92 and the airflow guide 100 is set for the diameter D of the opening 92 is as follows. When the shortest distance (the shortest distance) between the airflow guide 100 and the opening 92 is too small, the airflow guide 100 excessively obstructs the flow of air discharged through the opening 92, which causes the airflow to be not smooth, so that dew formation on the discharge panel 40 may not be prevented. Also, when the shortest distance is too large, the airflow guide 100 is too far from the opening 92, so that the airflow guide 100 may not substantially affect the flow of air discharged through the opening 92. Even in this case, dew formation on the discharge panel 40 may not be prevented.

Referring to FIG. 9, the airflow guide 100 may include a first coupling portion 110 and a second coupling portion 120 that are detachably coupled to the support panel 90. Also, the airflow guide 100 may include a connection portion 130 connecting the first coupling portion 110 and the second coupling portion 120 and extending in the up-down direction.

The first coupling portion 110 and the second coupling portion 120 may be provided to be symmetrical. That is, the structures of the first coupling portion 110 and the second coupling portion 120 are substantially the same. Hereinafter, for convenience of explanation, only the first coupling portion 110 will be described.

The first coupling portion 110 may include a coupling protrusion 111 inserted into a coupling groove (not shown) formed on the support panel 90, and a support groove 112 into which a support protrusion 93 protruding from the support panel 90 is inserted. The user may couple the coupling protrusion 111 to the coupling groove (not shown) by coupling the support protrusion 93 to the support groove 112 and then rotating the airflow guide 100 about a vertical axis. However, the airflow guide 100 may alternatively be formed integrally with the support panel 90. The airflow guide 100 may not include the first coupling portion and the second coupling portion and may be formed integrally with the support panel 90.

The second coupling portion 120 may include a coupling protrusion 121 inserted into a coupling groove (not shown) formed on the support panel 90, and a support groove 122 into which a support protrusion 93 protruding from the support panel 90 is inserted. The coupling protrusion 121 is couplable to the coupling groove (not shown) by coupling the support protrusion 93 to the support groove 122 and then rotating the airflow guide 100 about a vertical axis.

The connection portion 130 connecting the first coupling portion 110 and the second coupling portion 120 and extending in the up-down direction may include the first guide portion 131 and the second guide portion 132 described above. The rib 133 may be provided between the first guide portion 131 and the second guide portion 132.

A plurality of the ribs 133 may be provided and may be disposed to be spaced apart from each other along the up-down direction in which the connection portion 130 extends. The rib 133 may be provided between the first guide portion 131 and the second guide portion 132 to reinforce the rigidity of the connection portion 130.

Figure 10:
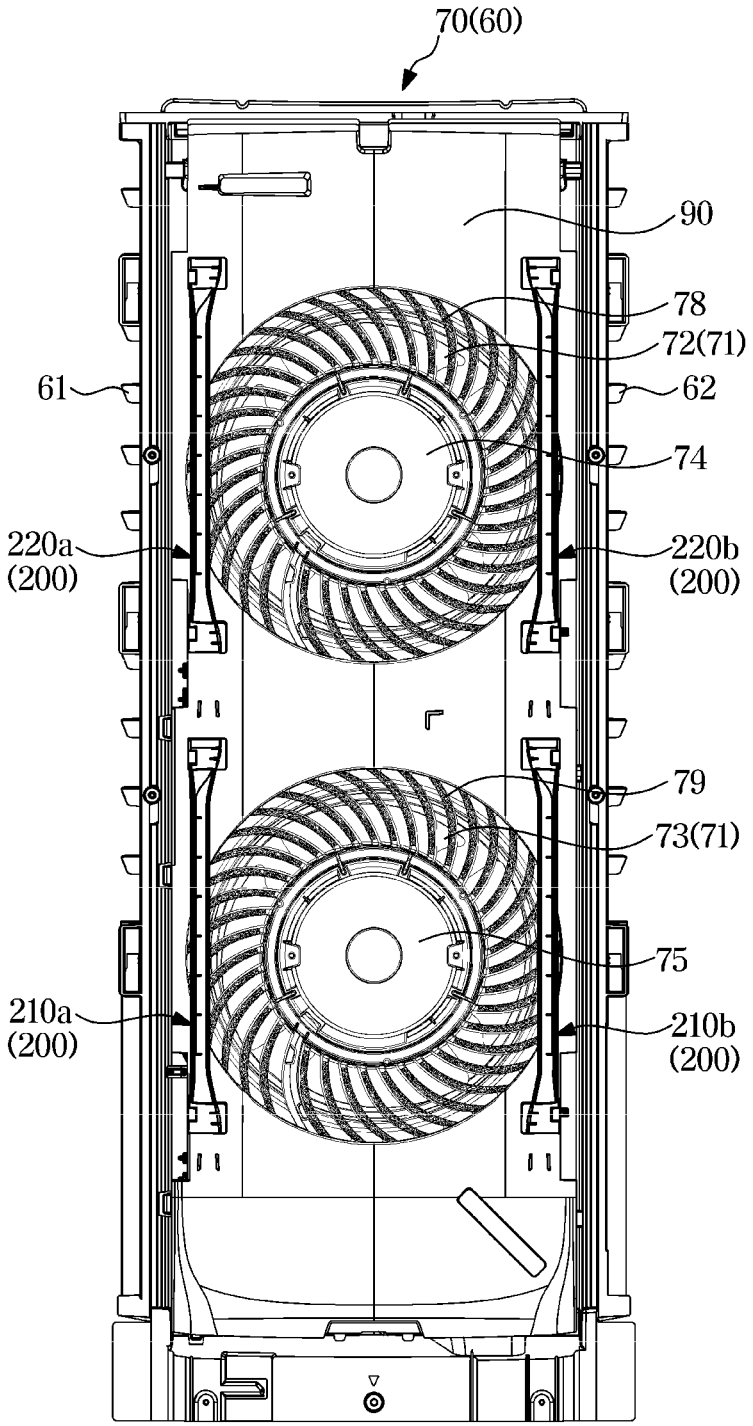
FIG. 10 illustrates a first blower in an air conditioner according to another embodiment of the disclosure.

FIG. 10 illustrates a first blower in an air conditioner according to another embodiment of the disclosure.

Hereinafter, an air conditioner according to another embodiment of the disclosure will be described with reference to FIG. 10. The content overlapping with the above will be omitted.

Referring to FIG. 10, an airflow guide 200 may include a plurality of airflow guides 210*a*, 210*b*, 220*a*, and 220*b*. The plurality of airflow guides 210*a*, 210*b*, 220*a*, and 220*b* may include the first airflow guide 210*a*, the second airflow guide 210*b*, the third airflow guide 220*a*, and the fourth airflow guide 220*b*.

The first airflow guide 210*a* and the second airflow guide 210*b* may be disposed on opposite sides of the front of a lower opening of a plurality of openings disposed up and down.

The third airflow guide 220*a* and the fourth airflow guide 220*b* may be disposed on opposite sides of the front of an upper opening of the plurality of openings disposed up and down.

As illustrated in FIG. 10, the air conditioner according to another embodiment of the disclosure may include the plurality of airflow guides 210*a*, 210*b*, 220*a*, and 220*b* disposed on the opposite sides of the front of each of the plurality of openings disposed up and down.

Figure 11:
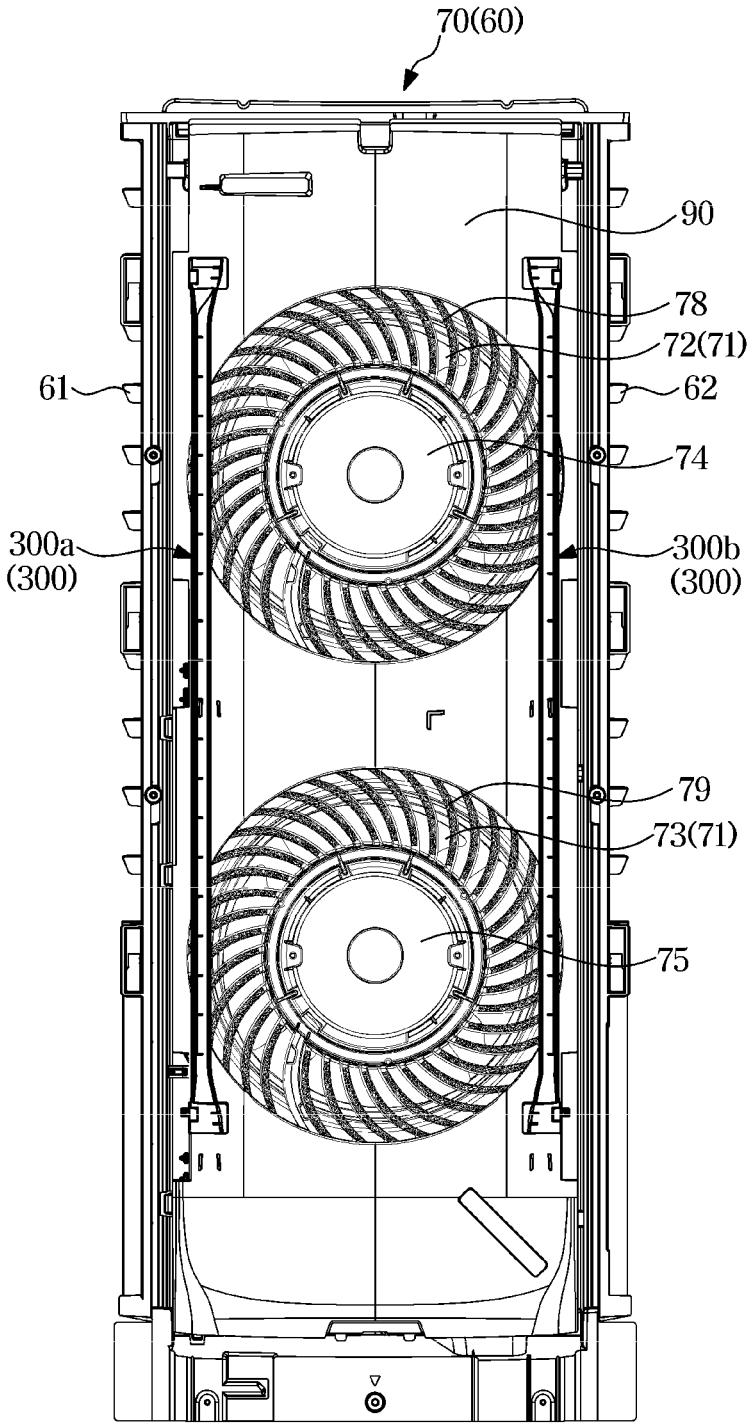
FIG. 11 illustrates a first blower in an air conditioner according to another embodiment of the disclosure.

FIG. 11 illustrates a first blower in an air conditioner according to another embodiment of the disclosure.

Hereinafter, an air conditioner according to another embodiment of the disclosure will be described with reference to FIG. 11. The content overlapping with the above will be omitted.

Referring to FIG. 11, an airflow guide 300 may include a first airflow guide 300*a* and a second airflow guide 300*b*. An opening disposed at a lower side among a plurality of openings is referred to as a first opening, and an opening disposed at an upper side is referred to as a second opening.

The first airflow guide 300*a* may extend in the up-down direction from one side of the front of the first opening to one side of the front of the second opening.

The second airflow guide 300*b* may extend in the up-down direction from the other side of the front of the first opening to the other side of the front of the second opening.

The airflow guide having the structure described above is too long in the up-down direction, and thus the modularization of one of the blowing fan and two of the airflow guides may not be suitable, but the modularization of the plurality of blowing fans and two of the airflow guides is suitable. This is because the number of assembly processes is reduced and the number of parts is reduced.

As is apparent from the above, according to an embodiment of the disclosure, an aft conditioner can be provided that includes a structure preventing dew from forming on a surface of a cabinet.

According to an embodiment of the disclosure, an air conditioner can be provided that guides air discharged from a blowing fan such that air outside a discharge panel does not flow into the discharge panel in an edge area of the discharge panel including a plurality of holes.

While the disclosure has been particularly described with reference to exemplary embodiments, it should be understood by those of skilled in the art that various changes in form and details may be made without departing from the spirit and scope of the disclosure.

What is claimed is:

1. An air conditioner comprising:

a housing including a first inlet and a second inlet and a first outlet formed on a front surface of the housing and a second outlet provided at one side of the first outlet;

a heat exchanger disposed between the first inlet and the first outlet;

a first blower disposed inside the housing to suck air through the first inlet and to guide air toward the first outlet;

a second blower disposed inside the housing to suck air through the second inlet and to guide air toward the second outlet;

a discharge panel disposed in front of the housing, the discharge panel including a plurality of holes through which air discharged from the first outlet passes; and an airflow guide disposed between edge regions of the discharge panel and the first blower along a direction the air is discharged from the first outlet so that the air guided by the first blower toward the first outlet is guided by the airflow guide toward the edge regions of the discharge panel along at least two directions, wherein the airflow guide is disposed between a center of the first outlet and the second outlet.

2. The air conditioner according to claim 1, wherein the airflow guide is configured to bring air from outside the discharge panel into contact with the discharge panel to thereby prevent dew from forming on the discharge panel.

3. The air conditioner according to claim 1, wherein the airflow guide guides air from around at least one edge region among the edge regions of the discharge panel such that the air discharged from the first blower moves from an inside of the discharge panel to an outside of the discharge panel through the plurality of holes.

4. The air conditioner according to claim 1, wherein a cross section of the airflow guide is formed in a V shape.

5. The air conditioner according to claim 1, wherein the airflow guide comprises, in order to guide the air discharged from the first blower to a left side and a right side, a first guide portion formed to extend to the left side with respect to the front of the housing, and a second guide portion formed to extend to the right side with respect to the front of the housing from one end of the first guide portion.

6. The air conditioner according to claim 5, wherein the first guide portion is longer than the second guide portion, the first guide portion being disposed to extend toward a center of an opening through which air flows inside the housing, or the second guide portion is longer than the first guide portion, the second guide portion being disposed to extend toward the center of the opening.

7. The air conditioner according to claim 5, wherein the airflow guide further comprises a rib provided between the first guide portion and the second guide portion to reinforce rigidity of the airflow guide.

8. The air conditioner according to claim 1, wherein the first blower comprises:

a blowing fan to suck and discharge air; and a support panel comprising an opening corresponding to the blowing fan to discharge the air sucked by the blowing fan.

9. The air conditioner according to claim 8, wherein the airflow guide is disposed on opposite sides of a front of the opening.

10. The air conditioner according to claim 8, wherein the airflow guide is coupleable to and decoupleable from the support panel.

11. The air conditioner according to claim 8, wherein the blowing fan is among a plurality of blowing fans arranged in a vertical direction, the support panel comprises a plurality of the openings corresponding to the plurality of blowing fans, respectively, and the airflow guide is one of airflow guides disposed on opposite sides of a front of at least one of the plurality of openings.

12. The air conditioner according to claim 8, wherein when a diameter of the opening is D and a length of the airflow guide in a vertical direction is H, a ratio H/D is in a range of $0.8<H/D<1.3$.

13. The air conditioner according to claim 8, wherein when a diameter of the opening is D and a shortest distance in a front-rear direction between the opening and the airflow guide is L, a ratio L/D is in a range of $0.07<L/D<0.11$.

14. The air conditioner according to claim 1, wherein the second outlet is configured to allow the air introduced through the second inlet to be discharged to be mixed with the air discharged from the first outlet.

15. The air conditioner according to claim 14, wherein the first blower is configured to suck and discharge air through a first flow path formed between the first inlet and the first outlet; and the second blower is formed between the second inlet and the second outlet and configured to suck and discharge air through a second flow path partitioned from the first flow path.

16. An air conditioner comprising:

a housing including an inlet through which air is introduced and an outlet through which air is discharged;

a heat exchanger disposed between the inlet and the outlet;

a blowing fan disposed inside the housing to suck air through the inlet and to guide air toward the outlet;

a fan case configured to fix the blowing fan to the inside of the housing and including an opening to discharge air sucked by the blowing fan;

a discharge panel disposed in front of the housing which includes the outlet, the discharge panel including a plurality of holes through which air discharged from the outlet passes; and an airflow guide formed on a left side and a right side of the opening of the fan case along a vertical direction of the housing, wherein the airflow guide is configured to guide air from the blowing fan through the opening and toward the left side and the right side of the opening of the fan case while the airflow guide is coupled to the fan case, wherein the airflow guide includes a first guide portion formed to extend to the left side with respect to the front of the housing, and a second guide portion formed to extend to the right side with respect to the front of the housing from one end of the first guide portion, and wherein the first guide portion is longer than the second guide portion, the first guide portion being disposed to extend toward a center of the opening through which air flows inside the housing, or the second guide portion is provided longer than the first guide portion, the second guide portion being disposed to extend toward the center of the opening.

17. The air conditioner according to claim 16, wherein a cross section of the airflow guide is formed in a V shape.

18. The air conditioner according to claim 16, wherein the airflow guide further comprises a plurality of ribs provided between the first guide portion and the second guide portion to reinforce rigidity of the airflow guide and disposed to be spaced apart from each other in the vertical direction.

* * * * *